US012298052B2

(12) United States Patent
Bollinger

(10) Patent No.: US 12,298,052 B2
(45) Date of Patent: May 13, 2025

(54) CRYOLINER

(71) Applicant: CRYOPORT, INC., Irvine, CA (US)

(72) Inventor: Bret Bollinger, Yorba Linda, CA (US)

(73) Assignee: Cryoport, Inc., Irvine, CA (US)

( * ) Notice: Subject to any disclaimer, the term of this patent is extended or adjusted under 35 U.S.C. 154(b) by 0 days.

(21) Appl. No.: 16/443,373

(22) Filed: Jun. 17, 2019

(65) Prior Publication Data

US 2019/0383547 A1 Dec. 19, 2019

Related U.S. Application Data

(60) Provisional application No. 62/686,410, filed on Jun. 18, 2018.

(51) Int. Cl.
*F25D 11/00* (2006.01)
*F25D 23/06* (2006.01)

(52) U.S. Cl.
CPC ..... *F25D 11/003* (2013.01); *F25D 23/066* (2013.01); *F25D 23/067* (2013.01); *F25D 2400/22* (2013.01)

(58) Field of Classification Search
CPC .... B65D 23/02; B65D 90/041; B65D 90/042; F17C 2203/0604; F17C 2203/0695; F17C 3/08; F17C 3/12; F25D 3/107; F25D 3/105; F25D 23/066; F25D 2303/08221; F25D 2400/20; F25D 3/06; F25D 11/003
See application file for complete search history.

(56) References Cited

U.S. PATENT DOCUMENTS 4,266,670 A * 5/1981 Mykleby ..... B65D 5/445 206/386
4,411,138 A * 10/1983 Leithauser ..... F17C 13/06 62/48.1
4,782,670 A * 11/1988 Long ..... F25D 3/08 62/530

(Continued)

FOREIGN PATENT DOCUMENTS

CN 1232954 A 10/1999
CN 204236989 4/2015

(Continued)

OTHER PUBLICATIONS

English Translation CN204236989U (Year: 2014).*

(Continued)

*Primary Examiner* — David J Teitelbaum
(74) *Attorney, Agent, or Firm* — Snell & Wilmer L.L.P.

(57) ABSTRACT

Methods, systems, devices and/or apparatuses for a protective liner that protects products and/or commodities from cross-contamination during transport and/or storage using a cryogenic shipping container. The protective liner lines a shipping container, such as a dewar. The protective liner is positioned within the shipping container. The protective liner includes one or more tabs positioned on a perimeter of the protective liner. The one or more tabs are configured to interlock with a notch on an inside surface of the shipping container. The protective liner includes a clearance channel on a side of the protective barrier and configured to guide a temperature sensor lead wire.

10 Claims, 5 Drawing Sheets

(56) References Cited

U.S. PATENT DOCUMENTS

| | | | | | |
|---|---|---|---|---|---|
| 4,974,423 | A * | 12/1990 | Pring | F25D 3/14 | 435/307.1 |
| 5,715,962 | A * | 2/1998 | McDonnell | B65D 21/086 | 220/4.03 |
| 5,789,684 | A | 8/1998 | Masek et al. | | |
| 5,857,351 | A * | 1/1999 | Angus | F25D 5/00 | 62/342 |
| 5,899,088 | A * | 5/1999 | Purdum | B65D 81/18 | 62/371 |
| 6,119,465 | A * | 9/2000 | Mullens | A01N 1/02 | 62/371 |
| 7,540,168 | B2 * | 6/2009 | Schumann | A01N 1/02 | 62/378 |
| 10,935,298 | B2 * | 3/2021 | Arnitz | F25D 3/105 | |
| 2009/0008405 | A1 | 1/2009 | Mathus et al. | | |
| 2012/0319309 | A1 | 12/2012 | Sorola et al. | | |
| 2016/0223243 | A1 | 8/2016 | Hardy et al. | | |
| 2017/0066582 | A1 | 3/2017 | Vogel et al. | | |
| 2017/0202213 | A1 * | 7/2017 | Gadrey | G01N 1/42 | |
| 2017/0343264 | A1 * | 11/2017 | McCormick | F17C 3/08 | |
| 2018/0149401 | A1 | 5/2018 | Arnitz et al. | | |

FOREIGN PATENT DOCUMENTS

| | | | | |
|---|---|---|---|---|
| CN | 204236989 U * | 4/2015 | B65D 81/18 | |
| JP | S60007822 A | 1/1985 | | |
| JP | H0640454 A | 2/1994 | | |
| JP | 2004042995 A | 2/2004 | | |
| JP | 2008189373 A | 8/2008 | | |
| JP | 2010-149909 | 7/2010 | | |
| JP | 2012515688 A | 7/2012 | | |
| JP | 2014508695 A | 4/2014 | | |

OTHER PUBLICATIONS

Translation CN204236989U (Year: 2015).*
PCT; International Search Report and Written Opinion dated Oct. 4, 2019 in PCT Application No. US2019/037501.
PCT; International Preliminary Report on Patentaiblity (IPRP) dated Dec. 22, 2020 in PCT/US2019/037501.
CN; Notice on First Office Action dated Feb. 21, 2022 in Application No. CN201980040277.8.
EPO; Supplemental Search Report dated Feb. 17, 2022 in Applicatiotn No. EP19823108.6.
GB; Examination Report dated Feb. 23, 2022 in Application No. GB2018505.4.
EPO; Supplemental Search Report dated May 20, 2022 in Application No. EP19823108.6.
SG; Written Opinion dated Aug. 1, 2022 in Application No. 11202011699.
GB; 2nd Examination Report dated Aug. 12, 2022 in Application No. 2018505.4.
CN; 2nd Office Action dated Oct. 17, 2022 in Application No. CN 201980040277.8.
UKIPO; Notice of Intention to Grant dated Jan. 1, 2023 for Application No. GB2018505.4.
JIPO; Notification of Reasons for Rejection dated Jul. 28, 2023 for Application No. 2020-569007.
AU; First Office Action dated Jun. 20, 2024 in Application Serial No. 2019290547.
EP; Examination Report dated Jul. 25, 2024 in Application Serial No. 19823108.3.
AU; 2nd Examination Report dated Oct. 24, 2024 in Application Serial No. 2019290547.
SG; Notice of Allowance dated Jun. 21, 2024 in Application Serial No. 11202011699.
EPO; Notice of Office Action dated Jul. 25, 2025 in Application Serial No. 19823108.6.

* cited by examiner

CRYOLINER

CROSS-REFERENCE TO RELATED APPLICATIONS

This application claims priority to and the benefit of U.S. Provisional Patent Application No. 62/686,410 titled "CRYOLINER," filed on Jun. 18, 2018, and the entirety of which is hereby incorporated by reference herein.

BACKGROUND

1. Field

This specification relates to a system, apparatus and/or a method for protecting against cross-contamination of products that are stored in a shipping container during transport and/or storage under cryogenic temperatures.

2. Description of the Related Art

In the health, medical, pharmaceutical and/or life science industry, cleanliness is an important aspect of the industry. In some instances, businesses may require sterilization and/or sanitization of a shipping container prior to the storage and/or transport of the product. In other instances, business may require specific-use shipping containers for the storage and/or transport of the product. These cleanliness and/or specific-use requirements are designed to prevent cross-contamination Currently, cleaning and sanitizing a dewar that stores a product at cryogenic temperatures uses a multi-step cleaning and sanitization process, which may take up to approximately 4 days to clean, sanitize and/or qualify the dewar for the next use. The multi-step process may include a thermal efficiency test and/or a cleaning process. The current cleaning process may involve warming the dewar and using an alcohol solution to wipe the inside of the dewar. The dewar requires a significant amount of time to warm. Since different materials within the dewar expand and contract at different rates, regular thermal cycling may cause damage to the dewar or the vacuum seal within the dewar and may cause a vacuum failure.

Accordingly, there is a need for a system, apparatus and/or method to protect the product inside the dewar from cross-contamination without warming the dewar.

SUMMARY

In general, one aspect of the subject matter described in this specification is embodied in a protective liner that lines a shipping container, such as a dewar. The protective liner is positioned within a shipping container. The protective liner includes one or more tabs positioned on a perimeter of the protective liner, the one or more tabs are configured to interlock with a notch on an inside surface of the shipping container. The protective liner includes a temperature sensor channel on a side of the protective liner. The temperature sensor channel is configured to guide a temperature sensor lead wire.

These and other embodiments may optionally include one or more of the following features. The protective liner may be a thin walled disposable liner that may be placed inside the shipping container prior to shipment. The temperature sensor channel may be configured to protect the temperature sensor lead wire from abrasion when a commodity or product is loaded into or unloaded out of the protective liner.

The protective liner may be flexible or collapsible. The one or more tabs may interlock with the notch to prevent accidental removal when loading or unloading the shipping container.

The protective liner may include a base. The base may be positioned at a bottom of the protective liner. The base may have one or more rigid protrusions to form the shape of the protective liner. The base may be configured to interlock with an accessory holder. The accessory holder may be configured to hold one or more accessories.

In another aspect, the subject matter is embodied in a cryogenic storage device. The cryogenic storage device includes a dewar for storing or transporting cryogenic material. The dewar has an inner surface and a notch on the inner surface. The cryogenic storage device includes a protective barrier positioned within the inner surface of the dewar. The protective barrier is configured to prevent contact between cryogenic material stored within the protective barrier and the inner surface of the dewar. The cryogenic storage devices includes an accessory holder positioned within the protective liner. The accessory holder is configured to accommodate multiple accessories.

In another aspect, the subject matter is embodied in a protective barrier. The protective barrier includes a protective liner. The protective liner is positioned within a shipping container and has a base. The protective liner includes one or more container attachment devices. The one or more container attachments devices are positioned on the perimeter of the protective liner. The protective barrier includes one or more accessory attachment devices. The one or more accessory attachment devices are configured to attach an accessory holder.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale, and may be exaggerated to better illustrate the important features of the present invention.

DETAILED DESCRIPTION

Disclosed herein are systems, devices and/or methods for a protective barrier that withstands cryogenic temperatures and is used to protect against cross-contamination of stored material when re-using a shipping container, such as a dewar. The protective barrier may be a liner, such as a cryoliner, that protects the dewar from contamination by a product or material stored within the protective barrier. The protective barrier prevents cross-contamination of products across different shipments or deliveries.

Other benefits and advantages include increasing asset utilization and inventory flexibility. By protecting the dewar from contamination using the protective barrier, the amount of time necessary to sanitize or clean the dewar prior to re-use is reduced. Typically, a dewar is checked for thermal efficiency and then warmed for cleaning. Once the dewar is cleaned, the liquid nitrogen that cools the dewar is refilled. The use of the protective barrier eliminates or reduces the amount of cleaning time, and thus, reduces the amount of time that the dewar is in maintenance. Thus, the dewar may be put to use more frequently. Moreover, the use of the protective barrier may allow for the re-use of the dewar without the need to warm the dewar for cleaning, and thus, reduce any naturally occurring damage due to thermo-cycling, which reduces the mean time to repair.

Additionally, the protective barrier may have an accessory holder. The accessory holder may hold various types of accessories used in transport of the product. This facilities the transport and storage of the product.

Figure 1A:
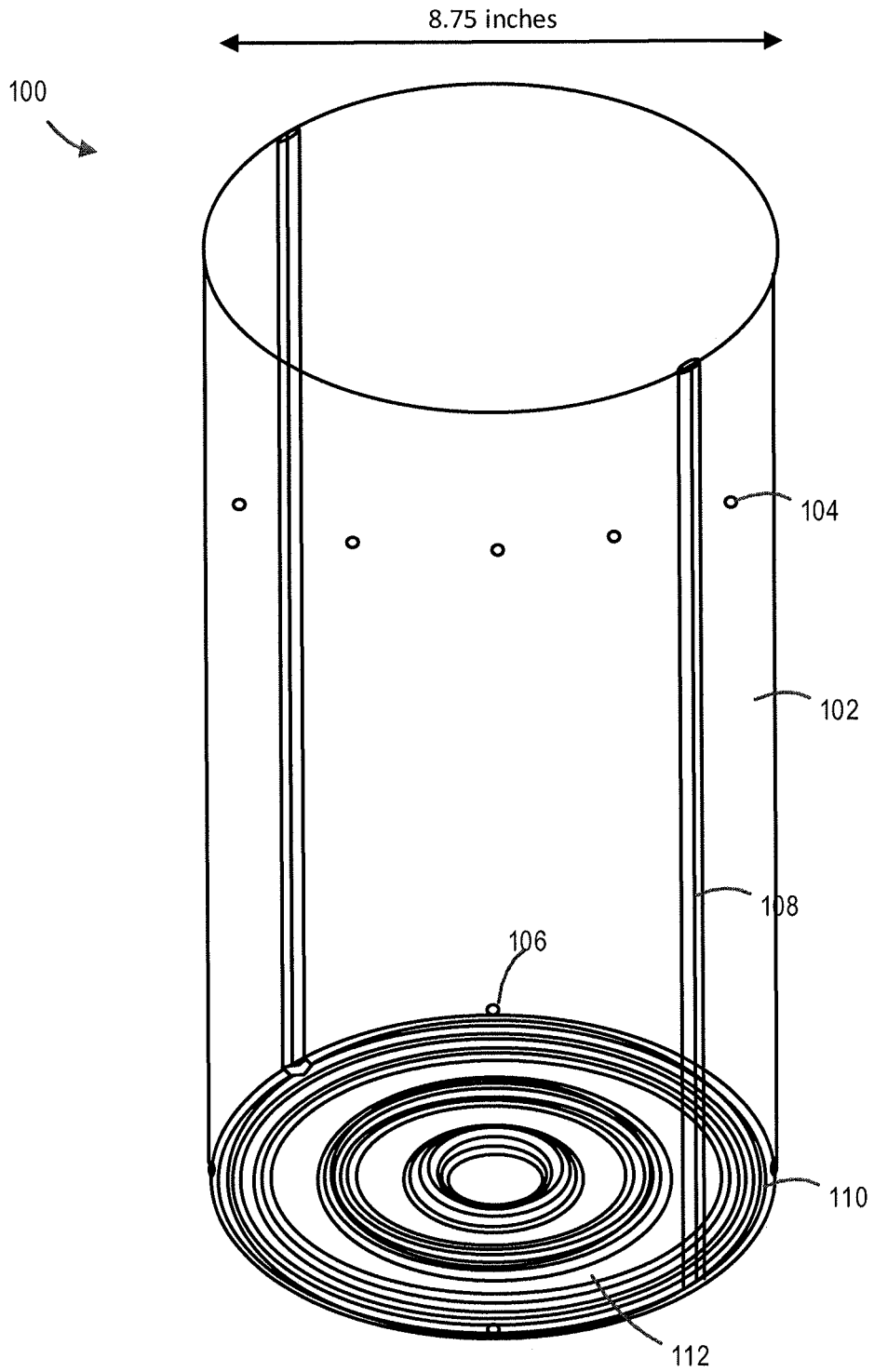
FIG. 1A shows an example of a large protective barrier according to an aspect of the invention.
Figure 1B:
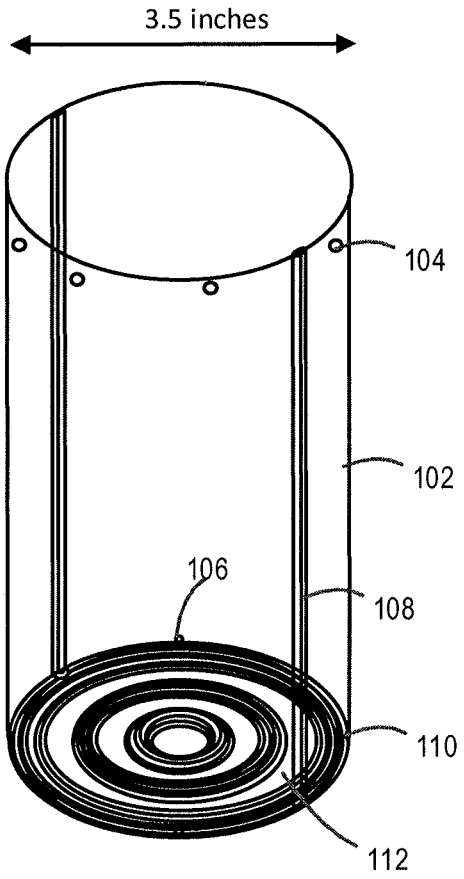
FIG. 1B shows an example of a small protective barrier according to an aspect of the invention.
Figure 2:
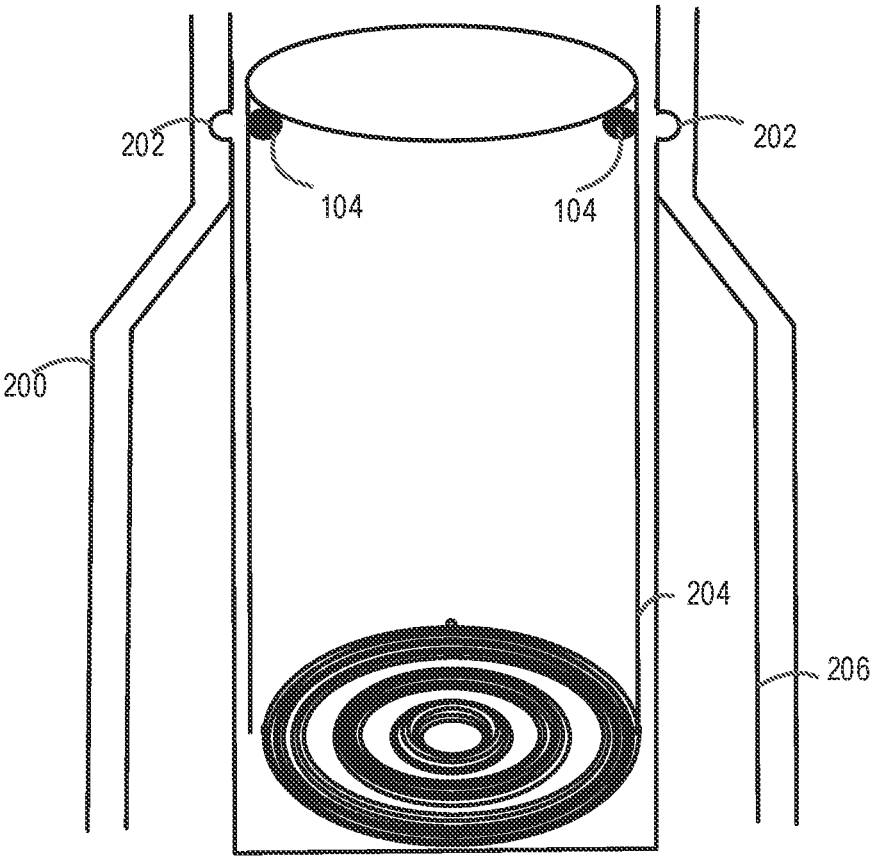
FIG. 2 shows an example dewar with a protective barrier according to an aspect of the invention.

FIGS. 1A-1B show a protective barrier 100 according to one embodiment that prevents contamination of the shipping container, such as a dewar, by a product or commodity stored within the shipping container. In this embodiment, the protective barrier 100 is positioned within a payload area that is between an inner vessel of the shipping container and the product or commodity stored within the shipping container, as shown in FIG. 2 for example. The protective barrier 100 may be of various sizes to accommodate different types of dewars, which have different sizes of payload areas. The protective barrier 100 may be for a high volume dewar that has a diameter between 8-9 inches, such as approximately 8.75 inches, as shown in FIG. 1A for example. The protective barrier 100 may be for a low volume dewar that has a diameter of between 3-4 inches, such as approximately 3.5 inches, as shown in FIG. 1B for example. However, other sizes of the liner may be used and fall within the scope of the present invention.

The protective barrier 100 may be flexible and/or collapsible. The protective barrier 100 may be able to withstand cryogenic temperatures, such that when placed within a cryogenic shipping container, the protective barrier 100 does not become too brittle. In one aspect of the protective barrier 100, the protective barrier 100 may have various components that interlock and/or interface with a dewar 200, an accessory holder 300 or a temperature sensor lead wire.

Figure 3:
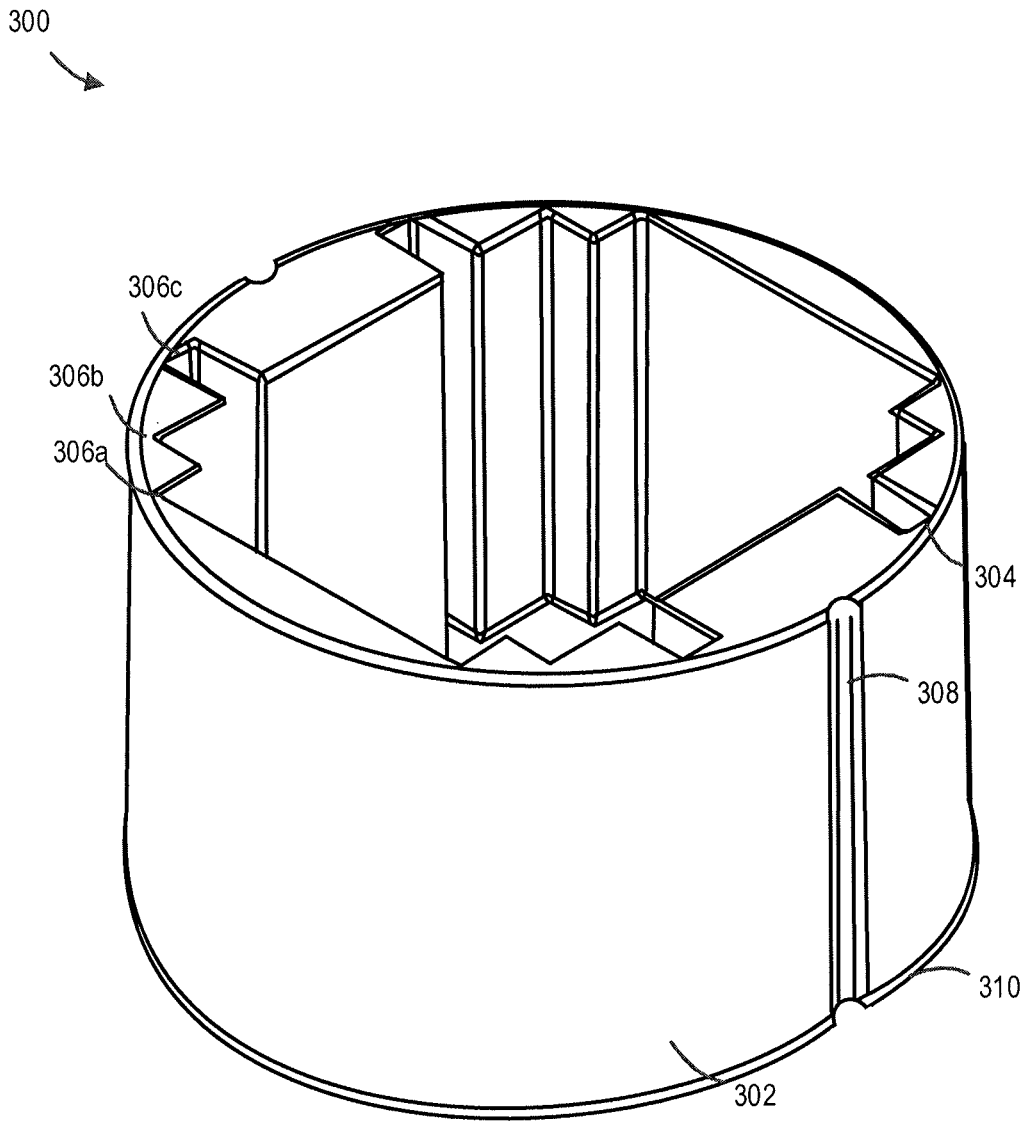
FIG. 3 shows an example accessory holder according to an aspect of the invention.

In one aspect of the invention, the protective barrier 100 may include or be formed from a liner 102, a protective covering or other layer of material that is positioned on an inner side or surface of an inner vessel of the dewar. The protective barrier 100 includes a liner 102, one or more container attachment devices 104 and one or more accessory attachment devices 106. The protective barrier 100 may include one or more temperature sensor channels 108 and/or an accessory holder 300, as shown in FIG. 3 for example.

The liner 102 may be a thin walled disposable liner that is placed inside the dewar prior to shipment. The liner 102 may be single-use, which allows the liner 102 to be disposed of after use. The liner 102 may be sterilized or otherwise cleaned before use and/or may have a layer of chemical, such as an anti-microbial agent, applied on the liner to assist with sterilization. This ensures a clean environment that has not come into contact with any products that could contaminate the new product being placed within the liner 102. After use, the liner 102 may disposed of and a new liner may be placed inside the dewar. Thus, the packer or shipper does not need to clean the dewar, and instead, may simply replace the disposable liner 102 and insert the new product prior to shipment. This reduces the amount of time that the dewar is unable to be used to transport and/or ship products, commodities and other materials. Moreover, the dewar does not need to be warmed to be cleaned, which reduces damage to the dewar.

In one aspect, the liner 102 may be made from a flexible material, such as polyethylene terephthalate (PETG), polyethylene or other plastic or plastic resin, at room temperature that is able to withstand cryogenic temperatures. The liner 102 may be collapsible and be easily conformable around an object or product that is inserted into an opening of the liner 102. When being transported within the dewar at cryogenic temperatures, the liner 102 may become more rigid. The liner 102 may be shaped as a cylinder, rectangle or other polygonal shape and have an opening that allows insertion of the product into the liner 102. The liner 102 may be shaped to correspond with a shape of a payload space of the dewar or other shipping container in which the liner is inserted to protect. In some implementations, the liner 102 may be made from a thin-walled steel material or other material with as low of a thermoconductivity coefficient as possible so that the liner 102 is not heat conductive.

The liner 102 may have a base 112 that has one or more protrusions 110. The base 112 may be positioned at the bottom of the liner 102. The one or more protrusions 110 may provide rigidity to form the shape of the liner 102. For example, the one or more protrusions 110 may be rigid and be shaped in concentric circles to form the circular shape of the base 112 and the overall cylindrical shape of the liner 102.

The protective barrier 100 includes one or more container attachment devices 104. In one aspect, a container attachment device may be a connector, a groove, a tab, a lip, a notch, a dimple or other indentation, fastener or protrusion that locks, interlocks, connects or otherwise attaches with a corresponding barrier attachment device 202 on the dewar 200, as shown in FIG. 2 for example. The one or more container attachment devices 104 may be positioned along the circumference or perimeter of the liner 102 and at different positions along the longitudinal length or height of the liner 102. The one or more container attachment devices 104 may face outward to interlock to the one or more barrier attachment devices 202. The barrier attachment device 202 on the dewar 200 may be a transition area, recess, crevice or a physical attachment, such as a tab, notch or other connector or fastener that interlocks with the container attachment device 104. The one or more container attachment devices 104 may prevent accidental removal of the liner 102 during the unloading or loading of the product when the one or more container attachment devices are connected to one or more barrier attachment devices.

For example, one or more tabs or dimples may be positioned along a middle portion of the liner 102. The one or more tabs or dimples may be positioned to form a row along the circumference or perimeter of the liner 102 and may be midway on the liner 102 to interlock, connect, attach or otherwise snap into a transition area or other corresponding barrier attachment device 202 on the dewar 200. The transition area or other corresponding barrier attachment device on the dewar may be positioned between the neck tube and the payload area of the dewar. In another example, the one or more tabs or dimples may be positioned at the top of the liner 102 and interlock, connect, attach or otherwise snap into a transition area or other corresponding barrier attachment device within the neck or top of the dewar.

The protective barrier 100 may have multiple rows of the one or more container attachment devices 104 that interlock, connect or otherwise attach with a corresponding barrier attachment device 202 on the dewar 200. For example, a first row of the one or more tabs or dimples may be positioned midway on the liner 102 and a second row may be positioned at the top of the liner 102. The first row of the one or more tabs or dimples may snap into a transition area that is midway between the neck tube and the payload area of the dewar 200, and the second row of the one or more tabs or dimples may snap into another transition area that is within the neck or top of the dewar 200. Different liners having different sizes or shapes may have different container attachment devices 104, which correspondingly interlock, attach, connect or otherwise fasten to different barrier attachment devices 202. Different container attachment devices 104 may be positioned on a single liner 102.

In some implementations, the one or more container attachment devices 104 may be formed from an epoxy, an epoxy resin or other adhesive. For example, the epoxy resin may adhere to and harden onto the liner 102, and then, may be inserted into, snapped into or otherwise fastened to a barrier attachment device 202.

The protective barrier 100 may include one or more temperature sensor channels 108, clearance channel, or other crevice or recess for allowing a temperature sensor lead wire to run along the liner 102. The one or more temperature sensor channels may be positioned on an outer surface of the liner 102 and run longitudinally along the length or height of the liner 102. The one or more temperature sensor channels 108 allow for the temperature sensor lead wires to be installed. When inserted within the one or more temperature sensor channels 108, the temperature sensor lead wires may be flush with the outer surface of the liner 102, such that the temperature sensor lead wires do not protrude from the outer surface of the liner 102. This protects the temperature sensor lead wires from abrasion during loading and unloading of the product or commodity stored within the dewar 200.

Figure 4:
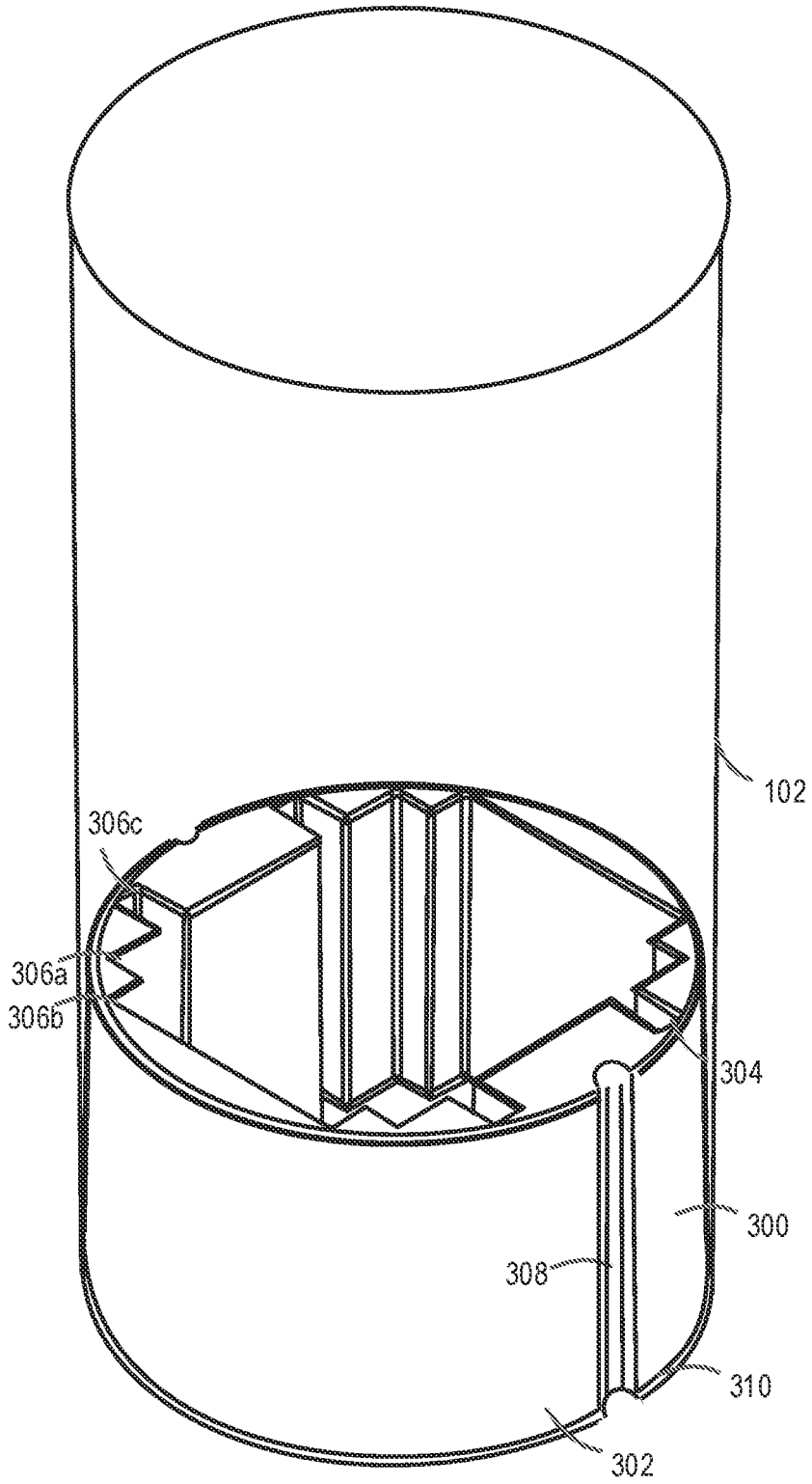
FIG. 4 shows an example protective barrier with an accessory holder according to an aspect of the invention.

The protective barrier 100 may include one or more accessory attachment devices 106. The one or more accessory attachment devices 106 may be a connector, a groove, a tab, a lip, a notch, a dimple or other indentation, fastener or protrusion that locks, interlocks, connects or otherwise attaches with an accessory holder 300, as shown in FIG. 4 for example. The one or more accessory attachment devices 106 may be positioned at the base 112 of the liner 102 or may be formed or molded within the base 112 of the liner 102. For example, the one or more accessory attachment devices 106 may be one or more dimples or tabs that are directed inward into the liner 102. The one or more accessory attachment devices 106 may connect to a base connector 310 of the accessory holder 300 to interlock the accessory holder 300 with the base 112 of the liner 102.

FIG. 2 shows a shipping container, such as a dewar 200, with a protective barrier 100 according to one embodiment of the invention. The dewar 200 has an inner vessel 204 and an outer vessel 206. The protective barrier 100 may be lined against and connected to the inner vessel 204 to prevent accidental removal of the protective barrier during the loading or unloading of the product or commodity. The dewar 200 may have one or more barrier attachment devices 202. The one or more barrier attachment devices 202 may be a notch, a recess, a hole, a crevice, a groove or other transition area, which interlocks with one or more container attachment devices 104, such as a dimple, tab or other attachment device, to secure the protective barrier 100 with the inner vessel 204 of the dewar 200.

In some implementations, the one or more barrier attachment devices 202 may be a fastener or other connector. The one or more barrier attachment devices 202 may be a female connector when the corresponding container attachment device 104 is a male connector or a male connector when the container attachment device 104 is a female connector.

The one or more barrier attachment devices 202 may be positioned along the inner circumference of the inner vessel 204 of the dewar 200. The one or more barrier attachment devices 202 may be positioned at various heights within the inner vessel 204. For example, the one or more barrier attachment devices 202 may be positioned within a portion of the neck of the inner vessel 204, such as at the top of the neck, midway down the neck or near the payload area of the dewar 200. In another example, the one or more barrier attachment devices 202 may be positioned midway up the payload area of the dewar 200. The position of the one or more barrier attachment devices 202 correspond to a position of the one or more container attachment devices 104.

FIG. 3 shows an accessory holder 300 according to one embodiment of the invention. The accessory holder 300 may have a single insert 302 with one or more nested features 306*a-c* that are molded within to accommodate multiple shapes of different accessories. In some implementations, the accessory holder 300 may have multiple inserts.

The one or more nested features 306*a-c* may have one or more slots 304, which hold an inserted accessory. The accessory holder 300 may hold multiple accessories of varying types within the one or more nested features 306*a-c*. The multiple accessories may be used in the transportation and/or storage of the products or commodities stored within the dewar 200 when inserted. For example, the accessory holder 300 may hold one or more criovial racks, one or more blood cassette racks, one or more blood cassettes and/or a combination of different types of accessories The one or more slots 304 that hold the different accessories may be shaped as a circle, a square, a rectangle or other polygon. For example, a blood cassette could go into a narrow rectangular slot and a criovial rack may be inserted into a square slot. In some implementations, a single slot may accommodate multiple different accessories based on an orientation of the different accessories.

The accessory holder 300 may have a base connector 310, such as a lip, a tab, a connector, a notch or other base connector that interfaces with the one or more accessory attachment devices 106 of the liner 102. A lip, for example, may engage, slip, slide underneath, or otherwise interface with a crevice, a recess, or a channel formed by a dimple or other accessory attachment device 106 and snap into, engage with or fasten to the accessory attachment device 106. For example, the lip of the accessory holder 300 may slide into a recess, crevice or other transition area formed by the one or more dimples or tabs to interconnect the accessory holder 300 with the liner 102, as shown in FIG. 4 for example.

The accessory holder 300 may have one or more channels 308 that conform to the one or more temperature sensor channels 108 of the liner 102. The one or more channels 308 may be positioned along the circumference of the outer surface of the accessory holder 300. The one or more channels 308 may extend longitudinally along the circumference of the outer surface and in parallel with the one or more temperature sensor channels 108. The one or more channels 308 may be a recess, an indentation or other channel within the outer surface of the accessory holder 300 and conform in shape to the one or more temperature sensor channels 108 of the liner 102. This allows a temperature sensor wire that runs along the temperature sensor channel 108 to be flush with the surface of the liner 102, when inserted or placed into the temperature sensor channel 108.

FIG. 4 shows a protective barrier 100 with an accessory holder 300 according to one embodiment of the invention.

The accessory holder 300 may be positioned at the base 112 of the liner 102. The accessory holder 300 has one or more channels 308 that are aligned with the one or more temperature sensor channels 108 of the liner 102, when the accessory holder 300 is properly inserted into the base 112 of the liner 102. The accessory holder 300 may interlock with the liner 102. For example, a base connector 310 may interface with an accessory attachment device 106 to interlock the accessory holder 300 with the liner 102 to prevent the accessory holder 300 from unintentionally disengaging from the liner 102. One or more accessory holders 300 may be stacked or otherwise arranged within different sizes of the protective barrier 100 to accommodate different configurations and different types of interchangeable accessories.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A cryogenic storage device, comprising:

a dewar for storing or transporting cryogenic material, the dewar having an inner surface and a first transition area and a second transition area on the inner surface;

a protective barrier positioned within the inner surface of the dewar and configured to prevent contact between cryogenic material stored within the protective barrier and the inner surface of the dewar, the protective barrier having a protective liner that has a first row of one or more tabs that snap into the first transition area and a second row of one or more tabs that snap into the second transition area, the protective liner having a base positioned at a bottom of the protective liner, the base having a plurality of rigid and concentric protrusions to form a shape of the protective liner, the plurality of rigid and concentric protrusions each being shaped in concentric circles; and an accessory holder positioned within the protective liner and configured to accommodate a plurality of accessories.

2. The cryogenic storage device of claim 1, wherein the protective barrier has one or more dimples, wherein the accessory holder is configured to snap or fasten to the one or more dimples to prevent accidental removal of the accessory holder.

3. The cryogenic storage device of claim 1, wherein the first row of the one or more tabs are positioned on a perimeter of the protective liner, wherein the protective liner has a temperature sensor channel on a side of the protective liner and that is configured to guide a temperature sensor lead wire.

4. The cryogenic storage device of claim 3, wherein the protective liner is a disposable liner.

5. The cryogenic storage device of claim 3, wherein the temperature sensor channel is configured to protect the temperature sensor lead wire from abrasion when the cryogenic material is loaded into or unloaded out of the protective liner.

6. The cryogenic storage device of claim 3, wherein the protective liner is collapsible.

7. The cryogenic storage device of claim 3, wherein the first transition area is positioned between a neck tube and a payload area of the dewar and the second transition area is positioned within the neck tube or a top of the dewar.

8. The cryogenic storage device of claim 1, wherein the base is configured to interlock with the accessory holder that is configured to accommodate the plurality of accessories.

9. A cryogenic storage device, comprising:

a dewar for storing or transporting cryogenic material, the dewar having an inner surface and a first transition area and a second transition area on the inner surface;

a protective barrier positioned within the inner surface of the dewar and configured to prevent contact between cryogenic material stored within the protective barrier and the inner surface of the dewar, the protective barrier having a protective liner, the protective liner having a base positioned at a bottom of the protective liner, the base having a plurality of rigid and concentric protrusions to form a shape of the protective liner, the plurality of rigid and concentric protrusions each being shaped in concentric circles; and an accessory holder positioned within the protective liner and configured to accommodate a plurality of accessories.

10. The cryogenic storage device of claim 9, wherein the protective liner has a temperature sensor channel on a side of the protective liner and that is configured to guide a temperature sensor lead wire.

* * * * *